United States Patent [19]

Book

[11] 4,446,630

[45] May 8, 1984

[54] METHOD AND APPARATUS FOR SLOW COOLING OF HEATED GRAIN

[75] Inventor: Gérard Book, Senlis, France

[73] Assignee: SECEMIA, Senlis, France

[21] Appl. No.: 310,067

[22] Filed: Oct. 9, 1981

[30] Foreign Application Priority Data

Oct. 9, 1980 [FR] France ..... 80 21590

[51] Int. Cl.[3] ..... F26B 17/14

[52] U.S. Cl. ..... 34/65; 34/168; 34/170; 34/175

[58] Field of Search ..... 34/20, 64, 65, 170, 34/167, 168, 52, 175

[56] References Cited

U.S. PATENT DOCUMENTS

| | | | |
|---|---|---|---|
| 921,395 | 5/1909 | Hager | 34/20 |
| 3,302,297 | 2/1967 | Graham | 34/65 |
| 3,701,203 | 10/1972 | Anderson | 34/170 |
| 3,710,449 | 1/1973 | Rathbun | 34/170 |
| 3,721,017 | 3/1973 | Niems | 34/170 |
| 4,020,561 | 5/1977 | Mathews | 34/167 |

*Primary Examiner*—Larry I. Schwartz
*Attorney, Agent, or Firm*—Darby & Darby

[57] ABSTRACT

Method and apparatus for the slow cooling of grain in which warm grain is introduced into the upper end of a silo and cooling air is introduced at the lower end and is evacuated at an intermediate point between the upper and lower ends of the silo. The warm grain descends through the silo in a non-ventilated space above the intermediate point where the internal moisture is removed, then into a ventilated space where it is cooled by the cooling air and finally to the lower end of the silo from which the cooled grain is extracted.

8 Claims, 7 Drawing Figures

METHOD AND APPARATUS FOR SLOW COOLING OF HEATED GRAIN

It is customary to proceed with drying of harvested grain in order to eliminate moisture before it is stored. This operation, at the present time, is commonly carried out in dryers working continuously, the grain being introduced into the upper part of the dryer and collected at the bottom thereof. Means are provided to admit, into the dryer, first hot air, into one or more top sections, then cold air into the bottom, to cool the grain before it is extracted from the dryer.

Also known is the provision, in a dryer of this general type, of at least one section in which there is no circulation of air (French Pat. No. 821,091, U.S. Pat. No. 3,701,203) so that the heat transmitted to the grain in the drying zone (or in a predrying zone) can permeate the zone and permit a rise in temperature of the grain as a whole.

As a result, during this period, there is a migration of the inside moisture toward the surface, which promotes drying.

But, during the time which the grain is being dried between the input orifice at the top and the base, the time of stay of the grain in these zones of relaxation or (re)drying, is necessarily very limited. It is, in fact, too short to permit a sufficient migration of the moisture in the grain toward the surface to permit a termination of the drying at the required degree, using just the effect of the cooling air.

Also known, moreover, is the removal from a dryer of grain which is not completely dry and still hot. In such a case, to complete the drying, the heat present in the grain as it leaves the dryer is utilized, by allowing the grain to rest in a cell. In the course of this rest, there is a drying of the internal moisture of the grain, which undergoes a migration toward the outside or toward the perimeter. The phenomenon that occurs can be compared to that intervening in the relaxation zone of a dryer as indicated above. But it is then of a much longer duration, which permits a more complete migration of the moisture toward the outside of the grain, and hence an easier extraction of this moisture. After this migration, all that is necessary is a ventilation of the grain with a low degree of renewal of the air to complete the drying and cooling.

The result of this known method, called the deferred slow cooling method, aside from a more homogenous and more efficient drying, as indicated above, is a gain in efficiency for existing dryers, a reduction in energy consumption, and an improvement in the quality of the grain.

As it is applied at the present time, however, this method has a certain number of drawbacks. As a matter of fact, it requires the use of a plurality of silos equipped with a deferred slow cooling system to follow the operating cycle of a continuous dryer. Moreover, control of the operation must be strict, in order to observe the necessary phases, which calls for the training of specialized personnel who must pay careful attention to their work.

It is the object of the invention to remedy the drawbacks of the known method.

The invention is directed to a method of deferred slow cooling of the still-hot grain, still loaded with excess moisture taken from a dryer. The method insures the gradual descent of the grain inside at least one column, first under non-ventilated conditions, then, after a time of descent corresponding to the time necessary for drying the internal moisture of the grain, in insuring the ventilation of this grain to complete the drying and cooling, while the said grain continues to progress downward inside the column. Collection of the dried and cooled grain from the column is carried out in an intermittent or continuous manner.

Thus, the known, general method of deferred slow cooling is implemented in a continuous manner as the grain progresses in the same column, avoiding the drawbacks resulting from the storage capacity required according to prior art. Inside the column, the grain is subjected to a very precise sequence of treatment which differs from that of a dryer in the sense that there is no heating of the grain for the drying, and this grain is simply subjected to a time of repose or drying, and then to a cooling ventilation.

This method combines the advantages resulting from the collection from a dryer of a grain that is not yet dried to the required degree and is still hot. This provides an accompanying gain in efficiency and reduction in energy consumption, and those advantages resulting from a more complete and longer drying of the grain, with the advantages of a continuous processing in an apparatus that is much more compact in comparison with existing installations.

According to a preferred embodiment of implementation, the ventilation of the grain as it progresses in the column, is insured by passage of air in counter-current to the direction of progression of the grain. Thus, according to the invention, it is possible to admit air in the vicinity of the point of exit of the grain relative to the column, i.e., at the point where the grain is already sufficiently cooled, thereby avoiding thermal shock to the grain and reducing cracks in the grain kernels.

According to another feature of the invention, the grain is ventilated under pressure, the admission of cold air being insured in the vicinity of the point of exit of the grain, relative to the column. The evacuation of the air at an intermediate level of this column is selected as a function of the required drying time. It is then possible to recover the energy contained in the air evacuated from the column, owing to the constant enthalpic level of this air, which is saturated and hot, and which is at practically the same temperature as the grain after drying. This recovery of energy can be obtained in any desired manner, for example by means of a heat exchanger, with condensation of the moisture contained in the air.

Still another advantage of the invention is that the homogeneity of the dried grain is imporved as a result of its uniform and continuous progression in the column. The contact modifications occurring between the grain kernels, in relation to adjoining grains promotes exchanges with the air, and hence increases the effectiveness of the ventilation.

The invention also relates to an installation for implementation of the method having at least one vertical column traversed by the grain. Means are provided to insure the admission of the still-hot grain from a dryer at the top of this column, with a view to keeping it always filled, and a means provided at the base of the column to insure the extraction of the dried, cooled grain. Cold, ventilation air is admitted toward the base of the said column and this ventilation air is evacuated at an intermediate level along the height of the column, so that the grain in this column will undergo an essentially continous downward displacement, with first of all a drying of the moisture in the upper part of the column, then a ventilation to complete the drying and the cooling thereof in the bottom part of the column.

The state of the art already includes, (U.S. Pat. No. 3,701,203, French Pat. Nos. 821,091 and 913,848, and British Pat. No. 647,490) the provision, in a dryer having a column equipped with an input for grain to be dried at the top thereof, a system of admission of cold air provided at the bottom of the column to cool the grain, this air being evacuated from the column at a point situated above this grain admission point. But dryers of this type are, on the one hand, intended for a totally different treatment of the grain, and on the other hand they have diverse means of admission and evacuation of hot air at different levels along the height of the column.

According to a preferred embodiment, the deferred slow cooling column for the grain includes a cooling silo of modular construction. This silo can then be fed with grain from one or more dryers, means being provided to keep it constantly filled. It is possible to provide, at the base of each module of the silo, a multi-cone system having means for operating the extraction of the grain. Such a multi-cone system insures the extraction in an essentially uniform fashion throughout the cross-section of the silo, and consequently a descent of the grain in the latter by horizontal layers.

The means insuring the extraction of the grain at the base of the column can include pneumatically operated traps or the like, programmed in appropriate fashion, or devices such as conveyor screws.

It is possible to provide, at the base of each cone, a tube connecting the duct of a conveyor screw driven at low speed in controlled fashion fo insure the proportioning of the extraction of the grain. This screw can in turn be connected to a high-output collector screw insuring the evacuation of the grain downstream of the installation, for example, for storage. Alternatively, a tube running from the base of each cone can terminate directly in the duct of an evacuation conveyor screw, with interposition of a gate, a register or similar device associated with means for regulation of the flow, to control the evacuation flow of the grain through this tube.

Such screw-type systems of evacuation and extraction have the advantage of low vertical bulk, combined with a reduction in cost for the supports.

Furthermore, the combination of two screws to form the extractor system constittues an essentially tight unit, which insures maintenance of the tightness during the extraction. According to another feature, in the case of a multi-cone system with extractors of the type mentioned above, it is possible to provide means permitting independent regulation of the extraction flows by lines at the base of the dryer, in order to make allowance, in particular, for the effects of walls, with a view to the obtaining a uniform extraction over the section of the silo.

According to still another feature, the base of each module is profiled so as to form a duct for passage and distribution of the cold air admitted, conjugated with means of entry for this air into the bottom part of the grain. Thus, in the case of a multi-cone system as indicated above, an air distribution duct can be formed between the downward directed conical or pyramidal evaulations, and caps or deflectors can be placed above the upper perforated part of this duct to permit the transfer of the air to the grain, without penetration of the latter into the interior of the duct. Each duct can be effectively embodied in the manner of a beam supporting the grain in the silo.

The invention also relates to a composite installation having one or more dryers and a continuous deferred slow cooling coumn for the grain as described above, as well as means connecting the base of the dryer or dryers to the top of this column in order to feed it with grain. In this arrangement the still-hot and still insufficiently dried grain, collected from the dryers, will undergo, in this continuous deferred slow cooling column, first a stage of drying without ventilation and then a cooling ventilation.

The following description, made in reference to the attached drawings provided in non-limiting fashion, will facilitate comprehension of the invention.

FIGS. 1 and 2 show an embodiment of a continuous deferred slow cooling installation for grain according to the invention. This installation comprises a silo, designated in a general way by reference 1, having a modular construction and providing enclosures, or columns, 2 for cooling grain.

Figure 1:
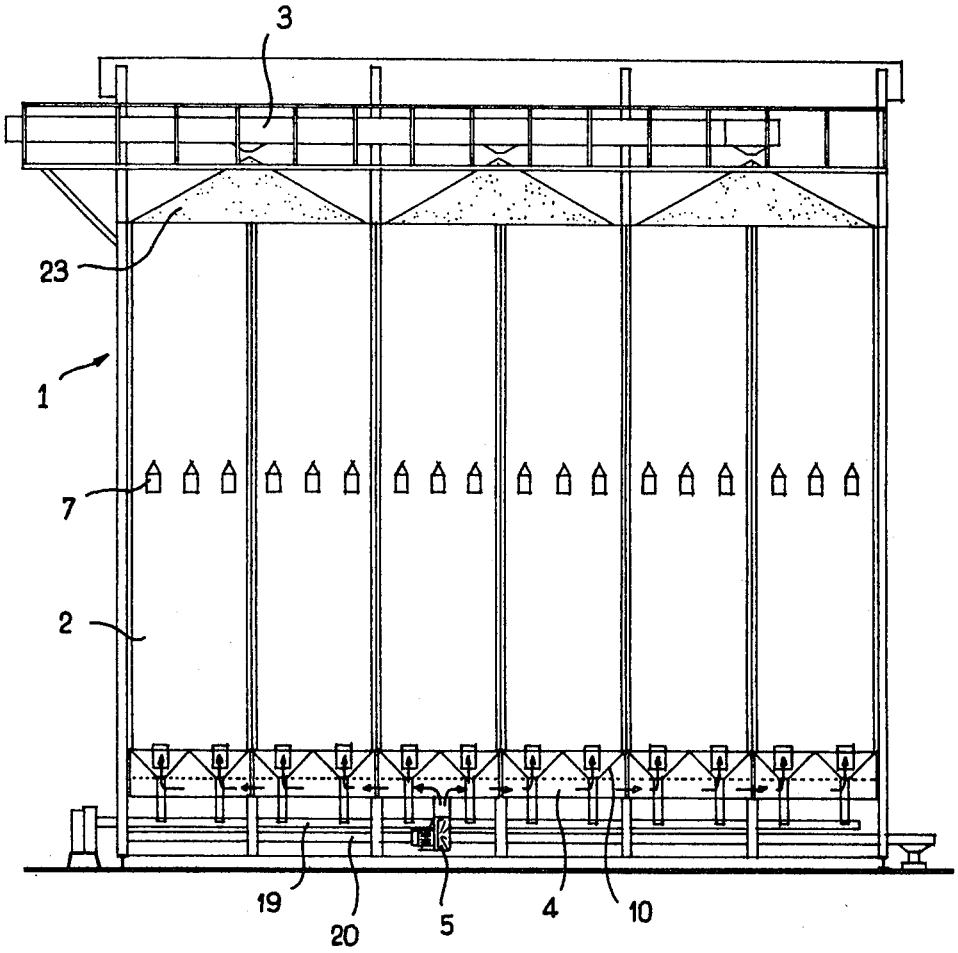
FIG. 1 is a schematic view in elevation of an installation for continuous deferred slow cooling of grain according to the invention.
Figure 2:
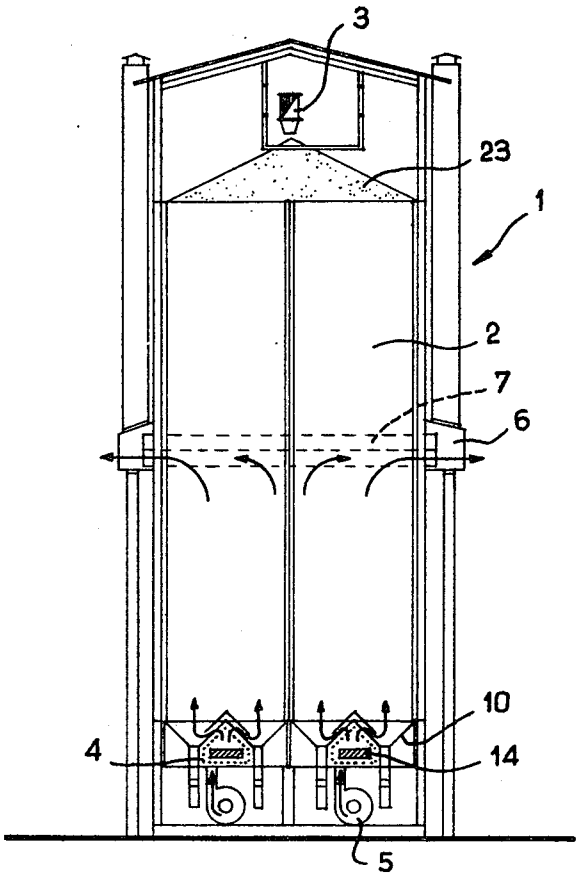
FIG. 2 is a view taken in a plane perpendicular to that of FIG. 1.

This silo is combined at the top with a grain feeding device, schematically shown at 3 in FIGS. 1 and 2, capable of bringing grain to the silo from a grain dryer, for example. It is desirable to provide devices monitoring the level of the grain in the silo, and feed regulating device, these devices being of known types.

According to the invention, there are provided, near the base of the silo, cold-air feeding and distribution ducts indicated at 4, which will be described in more detail below. Ducts 4 insure a uniform distribution of air throughout the base of the silo. These ducts 4 are fed from blowers 5.

At an intermediate level on the silo, there is a system of ducts 7 forming an air collector, which intercepts, and evacuates toward the outside at 6 (See FIG. 2), the drying and cooling air that has entered the silo through ducts 4.

Figure 4:
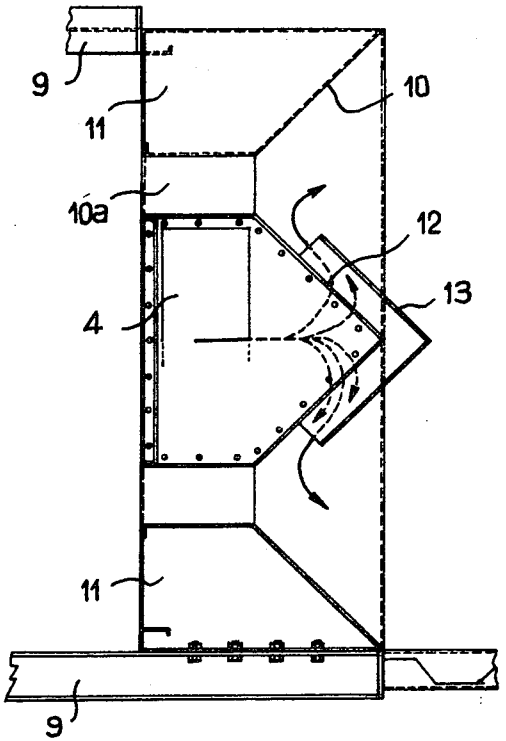
FIG. 4 is a sectional view through line IV—IV in FIG. 3.
Figure 3:
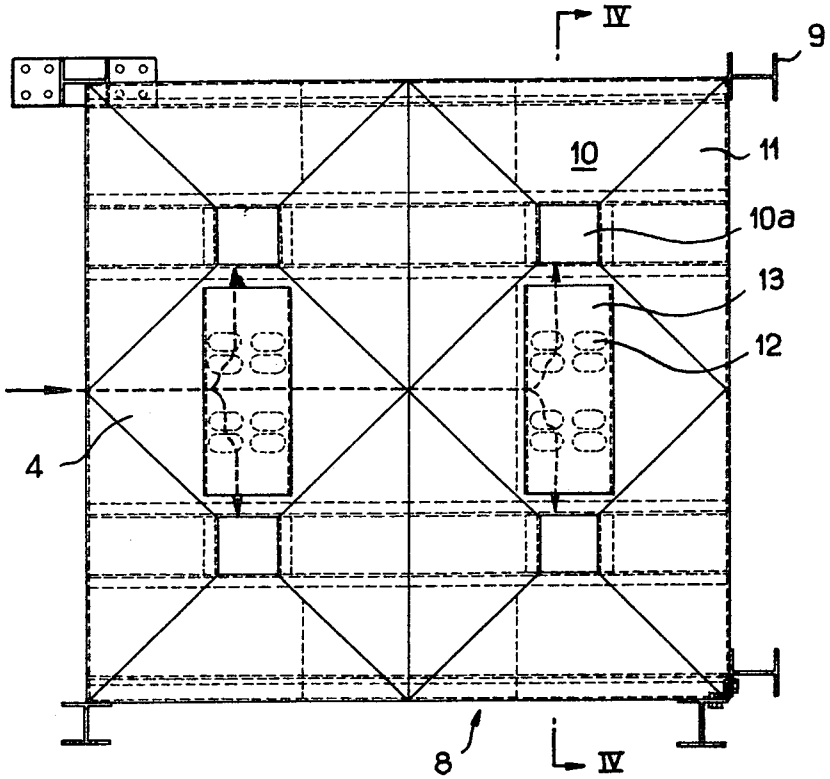
FIG. 3 is a plan view of the bottom part of a module.

FIGS. 3 and 4 show, in more detail, the bottom part of the silo with the means of admission of the air.

FIGS. 3 and 4 show a module, designated in a general way by 8, with supporting posts 9 and four cones 10 pointing downward for the outlet of the grain, the outlet orifices being indicated at 10*a*.

The central part of the module includes air intake duct 4, which acts as a beam supporting the weight of the grain in the silo. Lateral parts 11 likewise forming supporting beams, complete the modular structure of the base of this silo.

As indicated in FIGS. 3 and 4, the upper part of the central duct 4 has the form of a roof, and toward the peak of this part, there are air outlet orifices 12. This part equipped with orifices 12 is covered by a cap 13 supported at a certain distance from duct 4 so that, as indicated by arrows, particularly in FIG. 4, the air flowing through this duct 4 and emerging through orifices 12 will be deflected by the cap 13 and rise back into the interior of the grain substantially at the position of the outflow orifices 10*a* of the evacuation cones of the module.

Duct 4, insuring the movement of the air in a module, communicates with duct 4 of the next module after assembly of the modules, through rectangular orifices formed in the end flanks of the base, seen at 14 in FIG. 2. This communication is seen in FIG. 1.

It can be seen that, in this way a self-supporting structure is obtained from the base of the silo, which serves three different functions. As a matter of fact, this stucture supports the grain, avoiding a classic beam system with I and H profiles. It also permits a simultaneous extraction through multicones throughout the horizontal cross section of the silo, in a manner insuring a descent of the grain in horizontal layers, which subjects all the functions of the grain to a uniform slow cooling. And finally, by the ducts and the caps described, it forms a system of ventilation and injection of air into the grain, with direct distribution from one module to the next.

Figure 5:
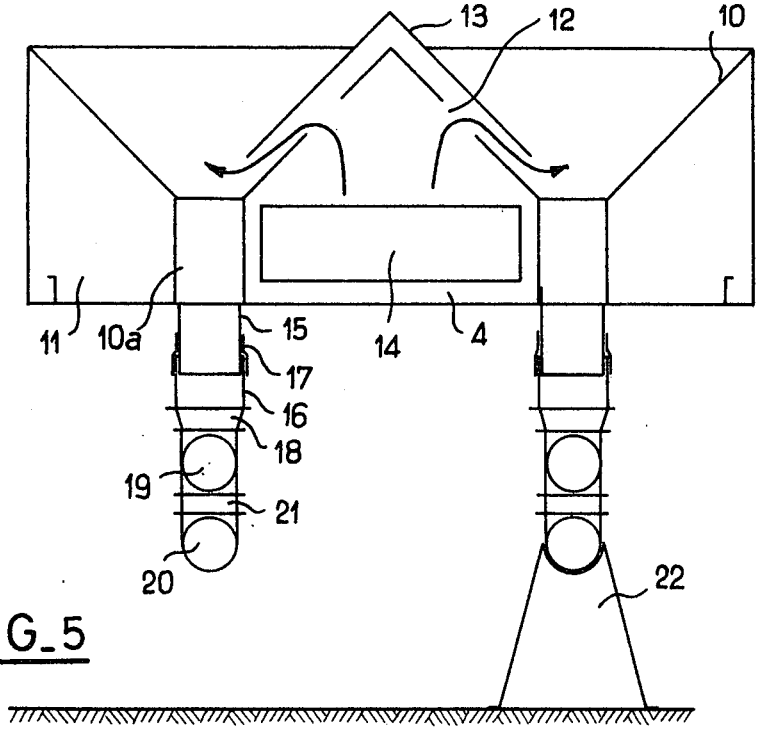
FIG. 5 is a partial schematic view showing the base of a module of the installation.
Figure 6:
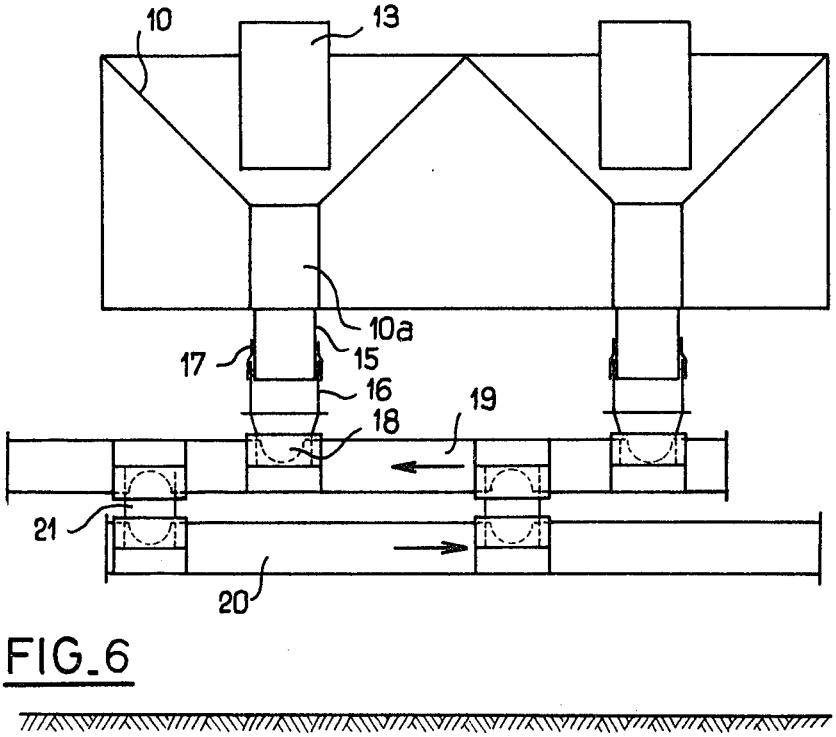
FIG. 6 is a view analogous to FIG. 5, but seen in a direction offset by 90 degrees.

FIGS. 5 and 6 show a preferred embodiment of the extraction system. The elements already seen in FIGS. 3 and 4 have been designated here by the same reference numerals. It will be noted that each orifice 10*a* of an extraction cone 10 is extended downward by a tube 15 to which is connected another tube 16 with interposition of a flexible, tight seal 17 that permits changes in shape, while avoiding air leaks. This tube 16 is connected in turn by a multipurpose connection 18 to a first duct 19 in which there is mounted a conveyor screw rotating at slow speed. The speed of rotation of this screw is regulated by a motor variable speed control which can be of the mechanical or electronic type, for example, permitting a precise proportioning of the extraction of the grain.

Below this first duct 19 is another duct 20, connected to the preceding one by connections 21, and in duct 20 there is mounted a higher speed output collection conveyor screw insuring the evacuation of the grain, for example, toward a storage station.

In FIG. 6, in which arrows indicate the direction of conveyance of the grain by the screws, it can be seen that the grain in the upper, low-output, duct 19 falls after a very short run into the lower, high-output, duct 21. As should be apparent, the direction of conveyance in the two ducts could be the same instead of being opposed.

This arrangement of the system of extraction and evacuation makes it possible to obtain a low overall height, and it can be supported by bases or posts as indicated at 22 in FIG. 5. One result of this low height is an appreciable saving in the cost of the bases. The need for wind-bracing structures are avoided, owing to the embedment of the lateral posts over the full height of the bases. Moreover, a system of extraction with two screws of this type constitutes a substantially tight extractor which insures maintenance of the air-tightness during the extraction.

The following is a description of the overall operation of a continuous deferred slow cooling silo according to the invention.

In FIGS. 1 and 2, 23 indicates the talus of grain coming from a dryer and brought by the feed device 3. The silo is filled with grain to its full height. Through the cones 10 and tubes 15, 16 at the base of the silo, there is a collection of a certain quantity of grain, as a function of the speed of the screw in tube 19. The mass of grain then undergoes a gradual downward displacement in the silo by horizontal layers. The speed of the screw can be regulated as a function of the time of stay required for the grain in the silo.

During the operation, the blowers 5 send cold air into the entirety of the base of the silo through ducts 4. This insures the cooling and the completion of the drying of the grain. This air, which enters the base of the silo, rises inside the mass of grain and is intercepted and evacuated toward the outside by the system of ducts 7 situated at an intermediate level.

Thus, in the upper part of the silo, the grain is not exposed to the effect of drying air. Hence, during the entire time that it progresses downward in the upper part of the silo, it undergoes an effect of drying of the internal moisture, similar to that obtained in the course of its resting in a cell. When the grain in the course of its descent arrives at the intermediate level of the system of ducts 7 and passes it, it begins to undergo the effect of the cool air which will complete the drying and cooling thereof.

Since the cold air is introduced into the silo through the base at the location of the extractors, this cold air comes in contact with grain that is, in principle, completely cooled, which avoids any thermal shock to the grain. As it progresses upward inside the grain, this air heats up on coming into contact with grain that is warmer and warmer, and the air leaving the silo is substantially at the temperature of the grain at the end of the drying stage. The air escaping outward can then be processed for recovery of the heat it contains, with condensation of the moisture.

Figure 7:
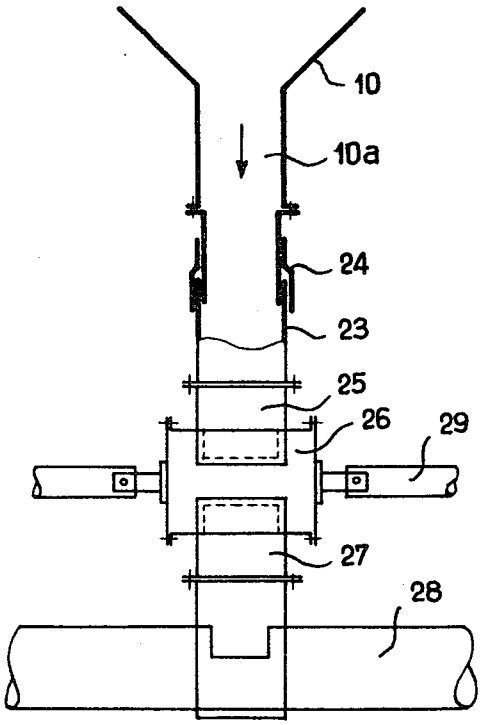
FIG. 7 is a view similar to FIG. 6, but corresponding to a variation of the embodiment.

FIG. 7 shows a variation of the arrangement of extraction of the grain at the base of the silo. In this case, a tube 23 is connected to the base of the orifice 10*a* of the cone 10, this tube being in two parts here, with interposition of a flexible seal 24. Tube 23 is extended downward by a pipe 25 connected to a gate body 26. An output pipe 27, running from this gate body 26, meets a duct 28 housing a collector screw.

A rotary gate of known type is mounted in the gate body 26. It is driven in rotation by a shaft 29, whose speed is regulated as a function of the output flow of the grain, and this consequently controls the time of stay of the grain in the silo.

The overall operation of a silo thus equipped is the same as above.

Modification can be imparted to the means of embodiment described within the domain of technical equivalents, without departing from the invention. Thus, as indicated above, the means of collection of the grain could be by pneumatic, register-type valves which can be operated all together, or one after the other, in a pre-opening pattern, determined here again as a function of the time of stay required for the grain inside the silo.

What is claimed is:

1. Apparatus for the slow cooling of grain comprising:

a silo having an upper and a lower end, means for introducing heated grains into the silo upper end, the grain moving toward the silo lower end, means for introducing cooling air into said silo adjacent the lower end thereof, means for evacuating the cooling air at a point intermediate the silo upper and lower ends, said cooling air evacuating means defining a non-ventilated space between said cooling air evacuating means and the silo upper end in which internal moisture of the heated grain is allowed to diffuse within the grain as the grain descends in the silo, and a space between the cooling air evacuating means and the lower end where the cooling air causes drying and cooling as the grain descends toward the silo lower end, and means at the lower end of said silo for extracting the cooled grain comprising a plurality of downwardly pointing cones, wherein said cooling air introducing means comprises means spaced above inlets to said cones to direct the flow of cooling air into said cone inlets.

2. Apparatus as in claim 1 wherein there are a plurality of said silos of modular construction.

3. Apparatus as in claim 2 wherein said extracting means extracts grain from a plurality of said silos.

4. Apparatus as in either of claims 2 or 3 wherein said grain extraction means for a silo comprises a first conduct means at the lower end of a silo into which the descending grain is funnelled, a second conduct means below said first conduct means and in communication therewith so that grain flows from said first to said second conduct means, and low and higher speed grain conveyor means in said first and second conduct means respectively.

5. Apparatus as in claim 1 further comprising deflecting means having a duct having outlets into said cones, and a cap above said outlets.

6. Apparatus as in claim 1 further comprising means for regulating the speed of operation of said extraction means to control the rate of descent of the grain in the silo.

7. Apparatus as in claim 2 wherein said means for introducing the cooling air is in common communication with all of said plurality of silos.

8. Apparatus as in claim 1 further comprising means for recovering the cooling air evacuated through said evacuating means.

* * * * *